US007758438B1

(12) United States Patent
Colomberti

(10) Patent No.: US 7,758,438 B1
(45) Date of Patent: Jul. 20, 2010

(54) GOLF AID APPARATUS

(76) Inventor: Maria R. Colomberti, 4432 S. Kilpatrick Ave., Chicago, IL (US) 60632

( * ) Notice: Subject to any disclaimer, the term of this patent is extended or adjusted under 35 U.S.C. 154(b) by 0 days.

(21) Appl. No.: 12/409,993

(22) Filed: Mar. 24, 2009

(51) Int. Cl.
*A63B 69/36* (2006.01)

(52) U.S. Cl. ..... 473/217; 473/270; 473/273

(58) Field of Classification Search ..... 473/207, 473/217, 218, 266, 270, 271, 272, 273, 452; 434/252
See application file for complete search history.

(56) References Cited

U.S. PATENT DOCUMENTS 3,175,827 A * 3/1965 Livingood ..... 473/217
3,300,219 A 1/1967 Sipos
3,343,842 A 9/1967 Woerner
5,062,643 A 11/1991 Bibbey et al.
5,472,200 A * 12/1995 Miller ..... 473/217
5,810,673 A 9/1998 Castleberry
5,947,832 A 9/1999 Gagne
6,375,582 B1 4/2002 Harris
D518,545 S 4/2006 Renahan et al.

* cited by examiner

*Primary Examiner*—Nini Legesse
(74) *Attorney, Agent, or Firm*—Crossley Patent Law; Mark A. Crossley

(57) ABSTRACT

The golf aid apparatus provides for instant fit and removal from either of a golfer's shoes, left or right. The apparatus fits the toe of the employed shoe and provides for a golfer to properly align feet, with the telescopic rod aimed toward an intended target of the golf swing. The apparatus is useful for proper alignment in any swing, including putting strokes. Fitting the toe provides for best visual alignment while also providing ease of fit and removal. The combined loop is slideably fitted around the telescopic rod so that a user has even more freedom in positioning the rod as desired. The rod is adjustable up to 20 inches in length.

18 Claims, 3 Drawing Sheets

FIG. 1
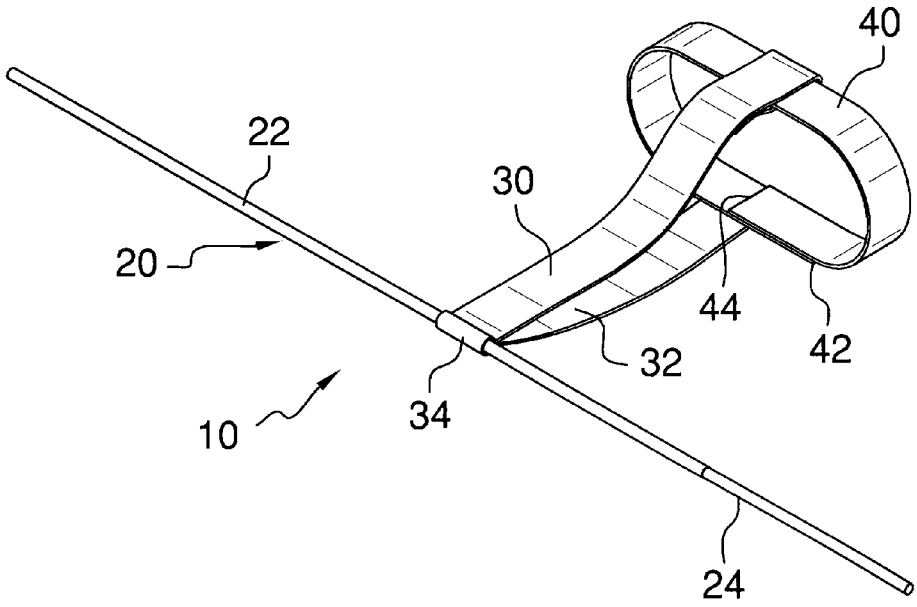
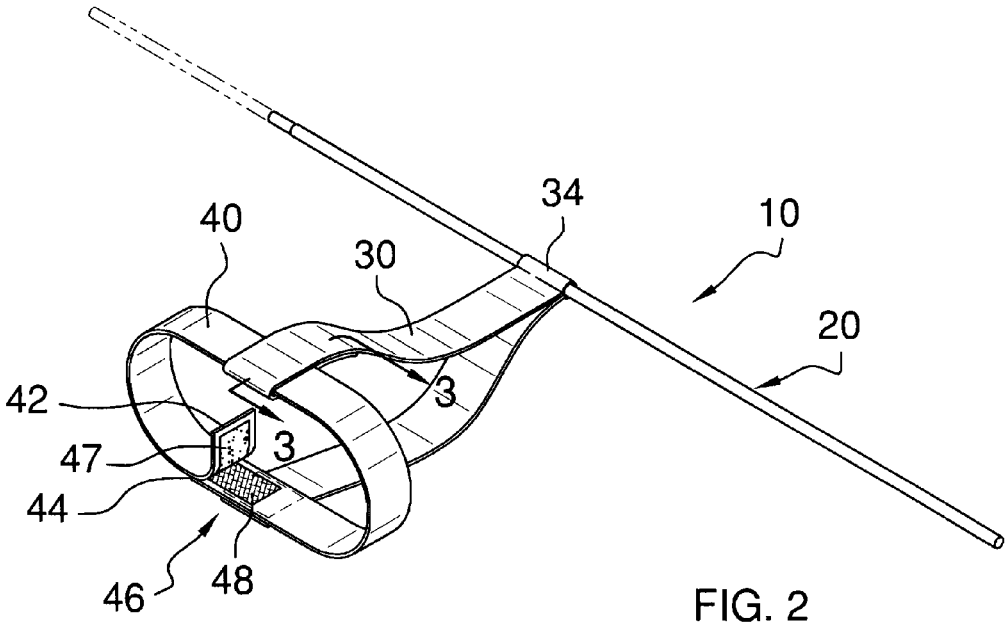
FIG. 2

GOLF AID APPARATUS

BACKGROUND OF THE INVENTION

Perhaps no sport provides more aid devices than does the game of golf. Golf is a complex sport that involves a summation of human movement and forces prior to, during and after ball contact. Each device has its own merits for helping a golfer learn or improve. Some devices vary tremendously, while others have only minor variations that separate them; therefore, even subtle differences can make a large difference in a complex series of alignments and movements involved in every golf stroke. Importantly, prior to a stroke, a player should align their feet such that an imaginary line is drawn across the toes of each foot and from thence to the intended target. The present apparatus provides a unique tool that quickly attaches and detaches from a player's shoe and provides reinforcement of correct foot-to-target alignment.

FIELD OF THE INVENTION

The golf aid apparatus relates to golf aids and more especially to an apparatus that provides a golfer with the tool needed for proper foot alignment with an intended target.

SUMMARY OF THE INVENTION

The general purpose of the golf aid apparatus, described subsequently in greater detail, is to provide a golf aid apparatus which has many novel features that result in an improved golf aid apparatus which is not anticipated, rendered obvious, suggested, or even implied by prior art, either alone or in combination thereof.

To attain this, the golf aid apparatus provides for instant fit and removal from either of a golfer's shoes, left or right. The apparatus fits the toe of the employed shoe and provides for a golfer to properly align feet, with the telescopic rod aimed toward an intended target of the golf swing. The apparatus is useful for proper alignment in any swing, including putting strokes. Fitting the toe provides for best visual alignment while also providing ease of fit and removal. The most complete embodiment provides adjustability of the top strap loop that slideably fits around the shoe strap. The combined loop joins the top strap to the bottom strap. Further, the most complete embodiment also provides slideable fit of the combined loop around the telescopic rod so that a user has even more freedom in positioning the rod as desired. Ideally, the rod is adjustable up to 20 inches in length. The rod does not infringe upon a golfer's foot movement and pivot. Additionally, the apparatus is useful in viewing an ending position of a user's feet after a swing is terminated, ensuring, for example, that the golfer isn't lifting one foot of performing some other error in movement. Once adjusted for fit, the apparatus slips on and off of a shoe instantly while remaining easily adjustable either on or off, and therefore easily used by more than one player.

Thus has been broadly outlined the more important features of the improved golf aid apparatus so that the detailed description thereof that follows may be better understood and in order that the present contribution to the art may be better appreciated.

An object of the golf aid apparatus is to assist a player with proper foot alignment with an intended target.

Another object of the golf aid apparatus is to negate any movement restriction or restraint of a golfer.

A further object of the golf aid apparatus is to apply and remove instantly.

An added object of the golf aid apparatus is to fit proximal to the toe of only one shoe of a golfer.

These together with additional objects, features and advantages of the improved golf aid apparatus will be readily apparent to those of ordinary skill in the art upon reading the following detailed description of presently preferred, but nonetheless illustrative, embodiments of the improved golf aid apparatus when taken in conjunction with the accompanying drawings.

In this respect, before explaining the current embodiments of the improved golf aid apparatus in detail, it is to be understood that the golf aid apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved golf aid apparatus. It is therefore important that the claims be regarded as including such equivalent constructions insofar as they do not depart from the spirit and scope of the golf aid apparatus. It is also to be understood that the phraseology and terminology employed herein are for purposes of description and should not be regarded as limiting.

BRIEF DESCRIPTION OF THE DRAWINGS

FIG. 1 is a perspective view.

FIG. 2 is a perspective view illustrating hook and loop attachment of the two ends of the shoe strap.

DETAILED DESCRIPTION OF THE DRAWINGS

Figure 3:
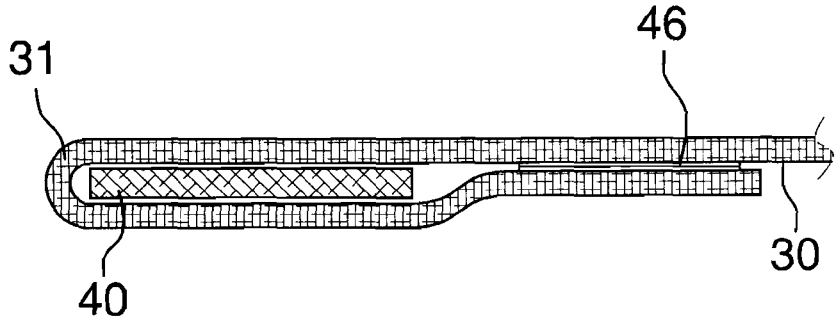
FIG. 3 is a partial cross sectional view of FIG. 2, taken along the line 3-3.

With reference now to the drawings, and in particular FIGS. 1 through 5 thereof, the principles and concepts of the golf aid apparatus generally designated by the reference number 10 will be described.

Referring to FIGS. 1 and 2, the golf aid apparatus 10 partially comprises a telescopic rod 20 having a second section 24 slideably fitted within a first section 22. The rod 20 ideally has a maximum length of about 20 inches. The elastic top strap 30 is joined to the elastic bottom strap 32 by the combined loop 34. The combined loop 34 is slideably fitted around the first section 22 of the telescopic rod 20.

Continuing to refer to FIGS. 1 and 2, and referring also to FIG. 3, the top strap loop 31 is disposed on an end of the top strap 30 opposite the combined loop 34. The top strap loop 31 is formed via a hook and loop 46 attachment of the top strap 30 to itself. The elastic shoe strap 40 is slideably fitted within the top strap loop 31. The shoe strap 40 has a first end 42 spaced apart from a second end 44. The first end 42 is selectively fastened to the second end 44. Hook 47 of hook and loop 46 is disposed on the shoe strap 40 adjacent to the first end 42. Loop 48 of hook and loop 46 is disposed on the shoe strap 40 adjacent to the second end 44. The shoe strap 40 length is thereby adjustable. The bottom strap 32 is affixed to the shoe strap 40 proximal to the second end 44.

Figure 4:
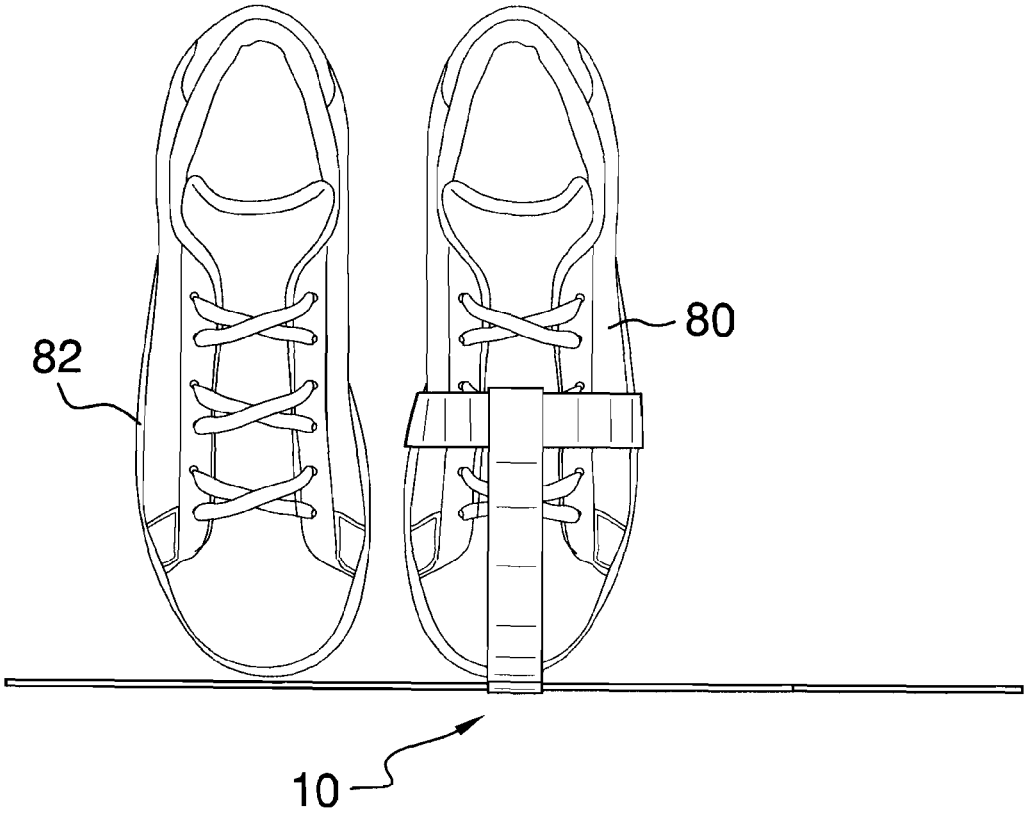
FIG. 4 is a top plan view of the apparatus installed on a shoe proximal to the toe.
Figure 5:
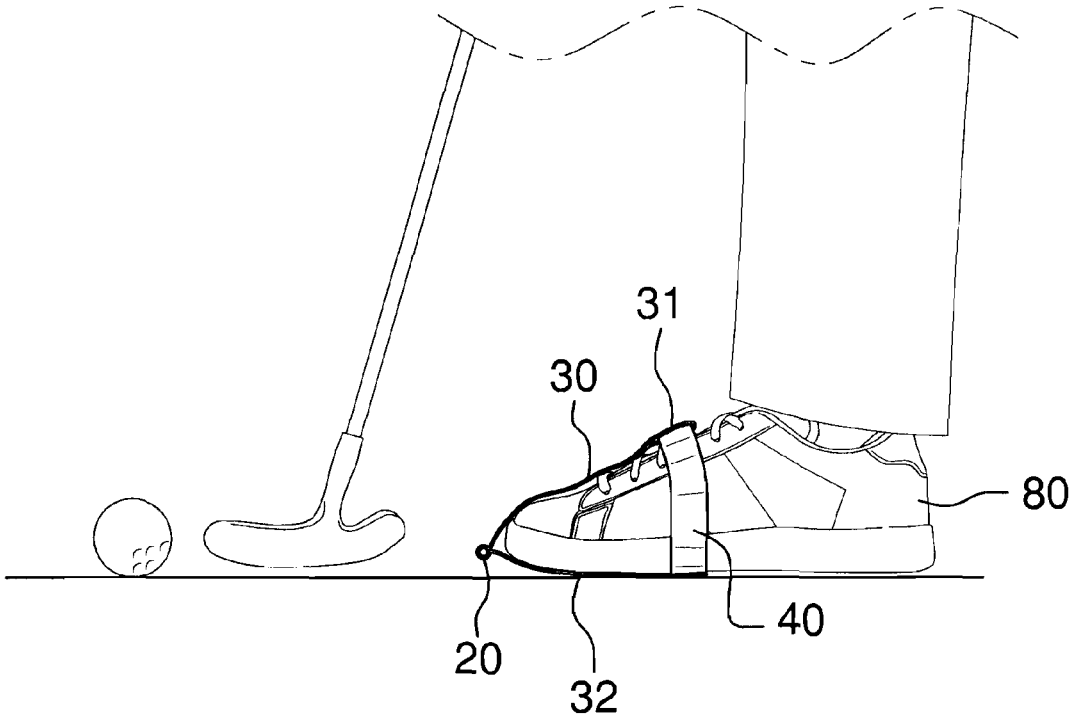
FIG. 5 is a left side elevation view of the apparatus in use.

Referring to FIGS. 4 and 5, the shoe strap 40 is selectively fitted around and proximal to the toe of a user's existing left shoe 80. The shoe strap 40 can also be fitted around the toe of an existing right shoe 82. Proper alignment of the telescopic rod 20 across the toes should point to the intended target. The apparatus 10 is instantly fitted to and removed from either shoe. The apparatus 10 is useful in proper alignment for any golf swing, including use in the putting stance illustrated in FIG. 5.

With respect to the above description then, it is to be realized that the optimum dimensional relationships for the parts of the golf aid apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the golf aid apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the golf aid apparatus may be used.

Therefore, the foregoing is considered as illustrative only of the principles of the golf aid apparatus. Further, since numerous modifications and changes will readily occur to those skilled in the art, it is not desired to limit the golf aid apparatus to the exact construction and operation shown and described, and accordingly, all suitable modifications and equivalents may be resorted to, falling within the scope of the golf aid apparatus.

What is claimed is:

1. A golf aid apparatus, comprising, in combination:

a rod having a length a top strap affixed to a bottom strap, the top strap joined to the bottom strap by a combined loop, the combined loop fitted around the rod;

an elastic shoe strap having an attachment to the top strap and the bottom strap, the attachment opposite the combined loop, the shoe strap selectively fitted around and proximal to a toe of a user's shoe, the top strap fitted over the shoe, the bottom strap fitted under the shoe.

2. The apparatus according to claim 1 wherein the top strap is further elastic;

the bottom strap is elastic.

3. The apparatus according to claim 2 wherein the combined loop is further slideably fitted to the rod.

4. The apparatus according to claim 3 wherein the shoe strap further comprises a first end spaced apart from a second end;

a hook of hook and loop disposed on the shoe strap adjacent to the first end;

a loop of hook and loop disposed on the shoe strap adjacent to the second end.

5. The apparatus according to claim 4 wherein elastic shoe strap attachment to the top strap further comprises a top strap loop on an end of the top strap opposite the combined loop, the top strap loop slideably fitted around the shoe strap.

6. The apparatus according to claim 3 wherein elastic shoe strap attachment to the top strap further comprises a top strap loop on an end of the top strap opposite the combined loop, the top strap loop slideably fitted around the shoe strap.

7. The apparatus according to claim 2 wherein the shoe strap further comprises a first end spaced apart from a second end;

a hook of hook and loop disposed on the shoe strap adjacent to the first end;

a loop of hook and loop disposed on the shoe strap adjacent to the second end.

8. The apparatus according to claim 7 wherein elastic shoe strap attachment to the top strap further comprises a top strap loop on an end of the top strap opposite the combined loop, the top strap loop slideably fitted around the shoe strap.

9. The apparatus according to claim 2 wherein elastic shoe strap attachment to the top strap further comprises a top strap loop on an end of the top strap opposite the combined loop, the top strap loop slideably fitted around the shoe strap.

10. The apparatus according to claim 1 wherein the combined loop is further slideably fitted to the rod.

11. The apparatus according to claim 10 wherein the shoe strap further comprises a first end spaced apart from a second end;

a hook of hook and loop disposed on the shoe strap adjacent to the first end;

a loop of hook and loop disposed on the shoe strap adjacent to the second end.

12. The apparatus according to claim 11 wherein elastic shoe strap attachment to the top strap further comprises a top strap loop on an end of the top strap opposite the combined loop, the top strap loop slideably fitted around the shoe strap.

13. The apparatus according to claim 10 wherein elastic shoe strap attachment to the top strap further comprises a top strap loop on an end of the top strap opposite the combined loop, the top strap loop slideably fitted around the shoe strap.

14. The apparatus according to claim 1 wherein the shoe strap further comprises a first end spaced apart from a second end;

a hook of hook and loop disposed on the shoe strap adjacent to the first end;

a loop of hook and loop disposed on the shoe strap adjacent to the second end.

15. The apparatus according to claim 14 wherein elastic shoe strap attachment to the top strap further comprises a top strap loop on an end of the top strap opposite the combined loop, the top strap loop slideably fitted around the shoe strap.

16. The apparatus according to claim 1 wherein elastic shoe strap attachment to the top strap further comprises a top strap loop on an end of the top strap opposite the combined loop, the top strap loop slideably fitted around the shoe strap.

17. A golf aid apparatus, comprising, in combination:

a telescopic rod having a second section slideably fitted within a first section;

an elastic top strap affixed to an elastic bottom strap, the top strap joined to the bottom strap by a combined loop, the combined loop slideably fitted around the first section of the telescopic rod;

an adjustable top strap loop on an end of the top strap opposite the combined loop, the top strap loop formed via a hook and loop attachment of the top strap to itself;

an elastic shoe strap slideably fitted within the top strap loop, the shoe strap having a first end spaced apart from a second end, the first end selectively fastened to the second end, the bottom strap affixed to the shoe strap proximal to the second end, the shoe strap selectively fitted around and proximal to a toe of a user's shoe;

a hook of hook and loop disposed on the shoe strap adjacent to the first end;

a loop of hook and loop disposed on the shoe strap adjacent to the second end.

18. The apparatus according to claim 17 wherein the rod further comprises a maximum length of about 20 inches.

* * * * *